US006092868A

United States Patent [19]

Wynn

[11] Patent Number: 6,092,868

[45] Date of Patent: Jul. 25, 2000

[54] COMPUTER WORK STATION

[76] Inventor: Jeffrey J. Wynn, 111 Bluebell Dr., Jackson, N.J. 08527

[21] Appl. No.: 09/213,113

[22] Filed: Dec. 17, 1998

[51] Int. Cl.[7] ..... A47C 7/62

[52] U.S. Cl. ..... 297/217.3; 297/188.05; 297/188.08; 297/188.14

[58] Field of Search ..... 297/146, 170, 297/174, 173, 188.05, 188.08, 188.13, 188.14, 217.3, 188.04; 345/168

[56] References Cited

U.S. PATENT DOCUMENTS

| | | | |
|---|---|---|---|
| 4,779,922 | 10/1988 | Cooper | 297/174 X |
| 5,022,706 | 6/1991 | Bryan | 297/162 |
| 5,452,950 | 9/1995 | Genshaw et al. | 297/174 X |
| 5,612,718 | 3/1997 | Bryan | 297/115 X |
| 5,713,633 | 2/1998 | Lu | 297/217.3 X |
| 5,765,910 | 6/1998 | Larkin et al. | 297/173 X |
| 5,779,305 | 7/1998 | Hocking | 297/170 X |

*Primary Examiner*—Peter H. Brown

[57] ABSTRACT

A computer work station for providing a comfortable location to work on a computer. The computer work station includes a reclining chair has a back rest, a seat, a leg rest, and a pair of arm rests. The reclining chair has a support base for supporting the reclining chair above a surface. A computer is mounted to the reclining chair. A pair of key pads electrically connected to the computer for inputting data into the computer are provided. Each of the arm rests has a key pad swivelably attached thereto. A monitor is pivotally connected to the back rest and is electrically connected to the computer for displaying visual images from the computer.

16 Claims, 3 Drawing Sheets

FIG 3
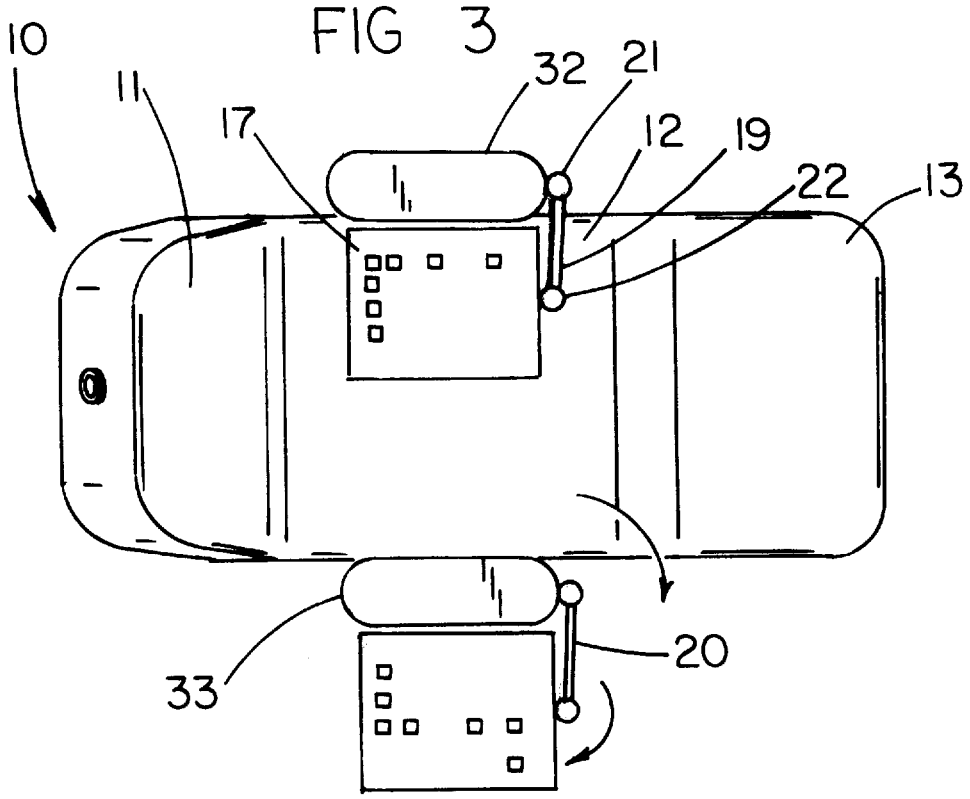
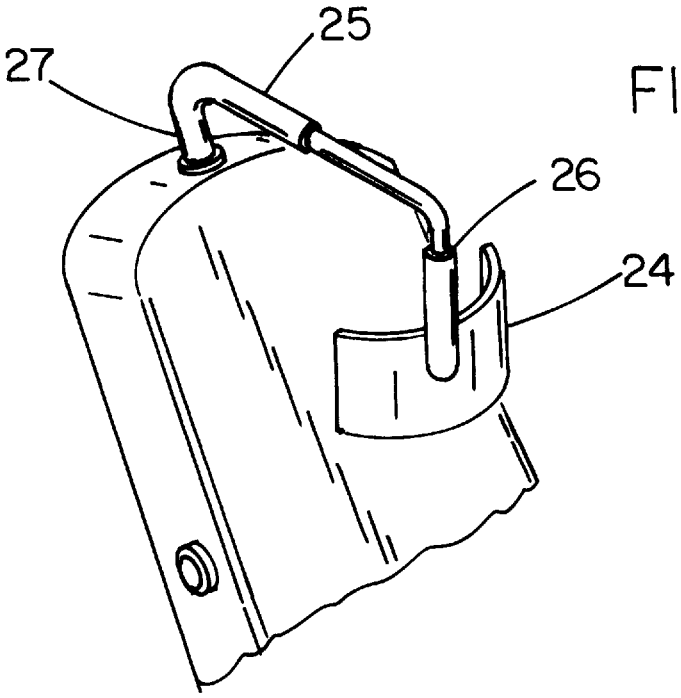
FIG 4

COMPUTER WORK STATION

BACKGROUND OF THE INVENTION

1. Field of the Invention

The present invention relates to computer work stations and more particularly pertains to a new computer work station for providing a comfortable location to work on a computer.

2. Description of the Prior Art

The use of computer work stations is known in the prior art. More specifically, computer work stations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,275,465; U.S. Pat. No. 5,275,482; U.S. Pat. No. 5,169,210; U.S. Pat. No. 5,022,706; U.S. Pat. No. Des. 247,010; and U.S. Pat. No. 5,292,173.

While these devices fulfill their respective, particular objectives and requirements, the aforementioned patents do not disclose a new computer work station. The inventive device includes a reclining chair has a back rest, a seat, a leg rest, and a pair of arm rests. The reclining chair has a support base for supporting the reclining chair above a surface. A computer is mounted to the reclining chair. A pair of key pads electrically connected to the computer for inputting data into the computer are provided. Each of the arm rests has a key pad swivelably attached thereto. A monitor is pivotally connected to the back rest and is electrically connected to the computer for displaying visual images from the computer.

In these respects, the computer work station according to the present invention substantially departs from the conventional concepts and designs of the prior art, and in so doing provides an apparatus primarily developed for the purpose of providing a comfortable location to work on a computer.

SUMMARY OF THE INVENTION

In view of the foregoing disadvantages inherent in the known types of computer work stations now present in the prior art, the present invention provides a new computer work station construction wherein the same can be utilized for providing a comfortable location to work on a computer.

The general purpose of the present invention, which will be described subsequently in greater detail, is to provide a new computer work station apparatus and method which has many of the advantages of the computer work stations mentioned heretofore and many novel features that result in a new computer work station which is not anticipated, rendered obvious, suggested, or even implied by any of the prior art computer work stations, either alone or in any combination thereof.

To attain this, the present invention generally comprises a reclining chair has a back rest, a seat, a leg rest, and a pair of arm rests. The reclining chair has a support base for supporting the reclining chair above a surface. A computer is mounted to the reclining chair. A pair of key pads electrically connected to the computer for inputting data into the computer are provided. Each of the arm rests has a key pad swivelably attached thereto. A monitor is pivotally connected to the back rest and is electrically connected to the computer for displaying visual images from the computer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new computer work station apparatus and method which has many of the advantages of the computer work stations mentioned heretofore and many novel features that result in a new computer work station which is not anticipated, rendered obvious, suggested, or even implied by any of the prior art computer work stations, either alone or in any combination thereof.

It is another object of the present invention to provide a new computer work station which may be easily and efficiently manufactured and marketed.

It is a further object of the present invention to provide a new computer work station which is of a durable and reliable construction.

An even further object of the present invention is to provide a new computer work station which is susceptible of a low cost of manufacture with regard to both materials and labor, and which accordingly is then susceptible of low prices of sale to the consuming public, thereby making such computer work station economically available to the buying public.

Still yet another object of the present invention is to provide a new computer work station which provides in the apparatuses and methods of the prior art some of the advantages thereof, while simultaneously overcoming some of the disadvantages normally associated therewith.

Still another object of the present invention is to provide a new computer work station for providing a comfortable location to work on a computer.

Yet another object of the present invention is to provide a new computer work station which includes a reclining chair has a back rest, a seat, a leg rest, and a pair of arm rests. The reclining chair has a support base for supporting the reclining chair above a surface. A computer is mounted to the reclining chair. A pair of key pads electrically connected to the computer for inputting data into the computer are provided. Each of the arm rests has a key pad swivelably attached thereto. A monitor is pivotally connected to the back rest and is electrically connected to the computer for displaying visual images from the computer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic top view of the present invention with one key pad in a first position over the seat and the other key pad in a second position away from the seat.

FIG. 4 is a schematic partial perspective view of another preferred embodiment of the present invention having a monitor mounted to the top of the back rest.

DESCRIPTION OF THE PREFERRED EMBODIMENT

Figure 1:
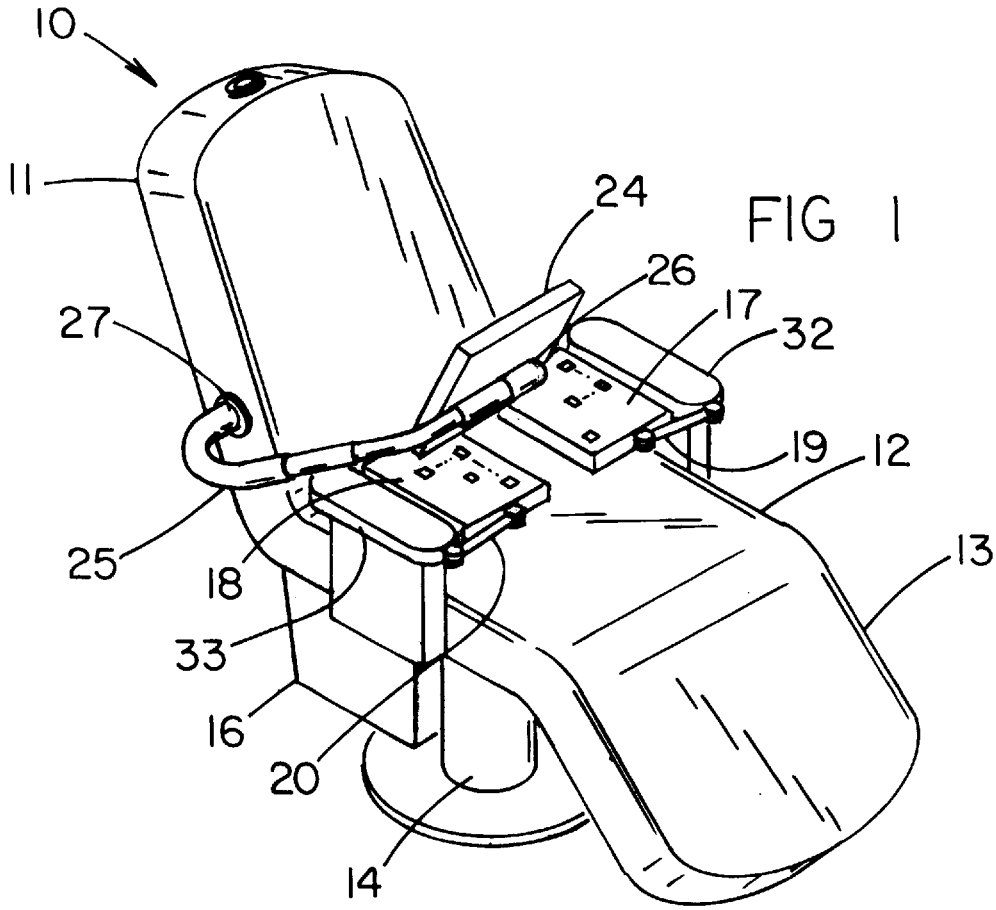
FIG. 1 is a schematic perspective view of a new computer work station according to the present invention.
Figure 2:
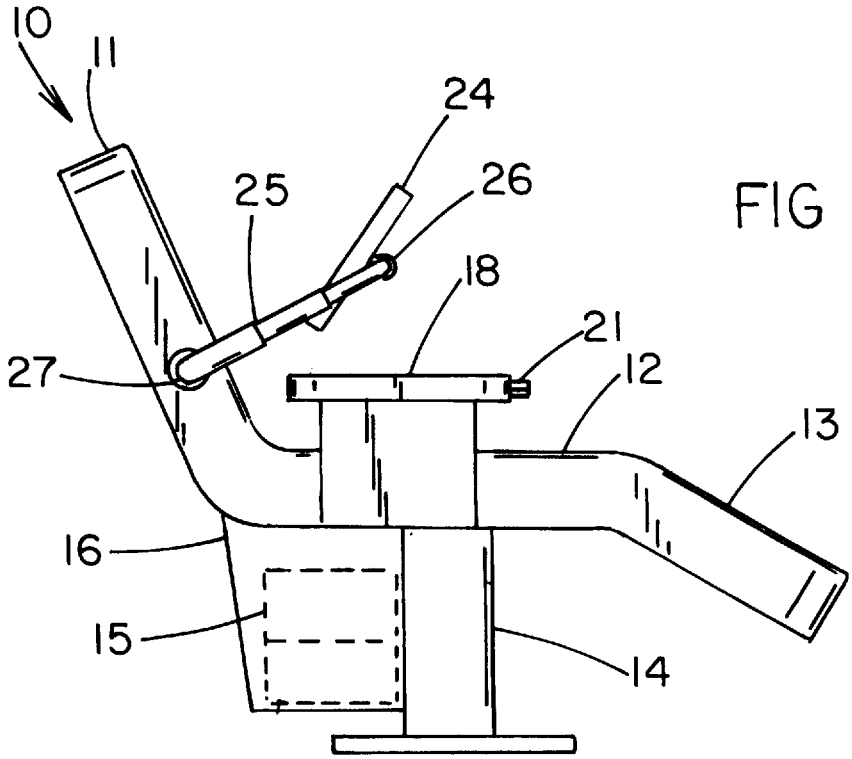
FIG. 2 is a schematic side view of the present invention.
Figure 5:
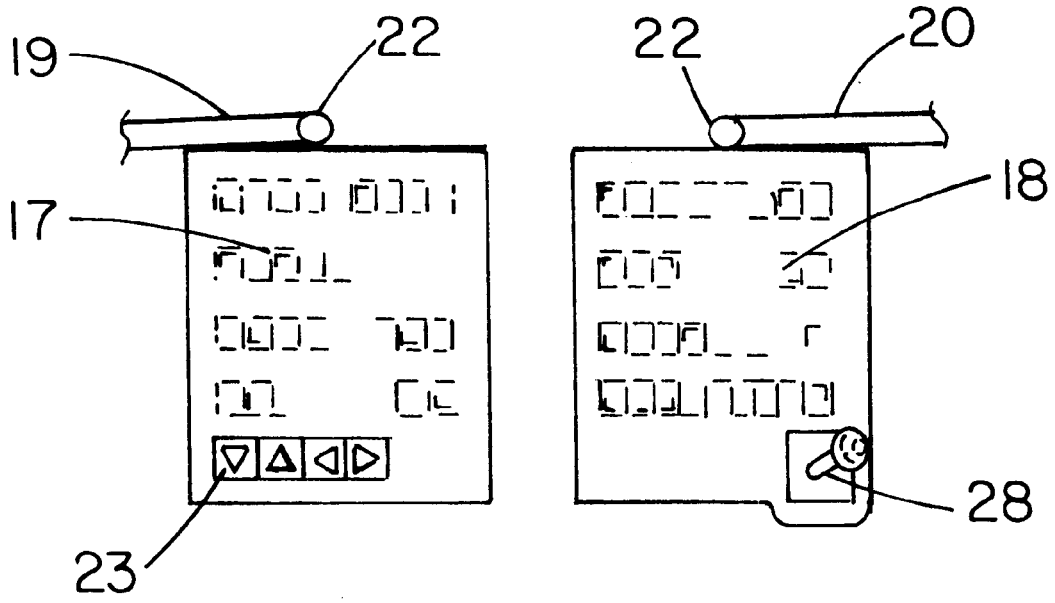
FIG. 5 is a schematic top view of the key pads of the present invention.

With reference now to the drawings, and in particular to FIGS. 1 through 6 thereof, a new computer work station embodying the principles and concepts of the present invention will be described.

As best illustrated in FIGS. 1 through 6, the computer work station generally comprises a reclining chair 10 has a back rest 11, a seat 12, a leg rest 13, and a pair of arm rests 32,33. The reclining chair 10 has a support base 14 for supporting the reclining chair 10 above a surface. A computer 15 is mounted to the reclining chair 10. A pair of key pads 17,18 electrically connected to the computer 15 for inputting data into the computer 15 are provided. Each of the arm rests 32,33 has a key pad swivelably attached thereto. A monitor 24 is pivotally connected to the back rest 11 and is electrically connected to the computer 15 for displaying visual images from the computer 15.

In use the computer workstation provides a comfortable area for working on a computer. In closer detail, the computer workstation includes a reclining chair 10 having a back rest 11, a seat 12, a leg rest 13 (or hassock), and a pair of arm rests 32,33. In use, the reclining chair 10 is designed for seating a user therein. The back rest 11 is pivotable with respect to the seat 12. The leg rest 13 is pivotable with respect to the seat 12. The reclining chair 10 has a support base 14 for supporting the reclining chair 10 above a surface. The support base 14 is adjustably raisable to permit selective raising and lowering of the reclining chair 10. The seat 12 is pivotable with respect support base 14. The reclining chair 10 preferably has a motorized device for pivoting the back rest 11, the seat 12, the leg rest 13, and raising and lowering the support base 14.

A computer 15 is mounted to the reclining chair 10. Preferably, the computer 15 is provided in a housing 16 mounted beneath the seat 12. The computer 15 includes a CPU, hard drives, CD-ROM Drives and other peripherals in the housing 16. The computer 15 also has an electric cord to permit connecting to an electrical power outlet and a number of input jacks for attaching other peripherals and inputs to the computer 15.

A pair of key pads 17,18 are electrically connected to the computer 15 for inputting data into the computer 15. Each of the arm rests 32,33 has a key pad 17,18 swivelably attached thereto. Preferably, each arm rest 32,33 has a swivel arm 19,20 swivelable attaching the associated key pad to the respective arm rest. Each swivel arm has a pair of ends 21,22. One of the ends 21 of each swivel arm 19,20 is pivotally attached to the associated arm rest while another of the ends 22 of each swivel arm 19,20 is pivotally attached to the associated key pad. With reference to FIG. 3, each of the key pads 17,18 is swivelable in a first position over the seat 12 and a second position extending away from the seat 12. The first and second positions preferably lie in a generally common plane. In use, the first position is designed for permitting the hands of the user to use the key pads 17,18 when sitting in the reclining chair 10.

A controller 23 for remotely controlling the pivoting of the back rest 11, the seat 12, and the leg rest 13 and the raising and lowering of the support base 14. The controller 23 is electrically connected to the motorized device and preferably provided on one of the key pads 17.

A monitor 24 is electrically connected to the computer 15 for displaying visual images from the computer 15. The monitor 24 is pivotally connected to the back rest 11. Ideally, the monitor 24 is a flat screen monitor 24 such as a liquid crystal monitor 24 provided on a laptop computer 15. Preferably, a pivot arm 25 pivotally connects the monitor 24 to the back rest 11. The pivot arm 25 has a pair of opposite ends 26,27. A first of the ends 26 of the pivot arm 25 is pivotally coupled to the monitor 24 and a second of the ends 27 of the pivot arm 25 is pivotally coupled to the back rest 11. In use, the pivot arm 25 permits pivoting of the monitor 24 to a position in front of the face of the user sitting in the reclining chair 10. In one preferred embodiment, the second end of the pivot arm 25 is pivotally coupled to a side of the back rest 11 as illustrated in FIG. 1. In another preferred embodiment, the second end of the pivot arm 25 is pivotally coupled to a top end of the back rest 11 as illustrated in FIG. 4. The pivot arm 25 has a length defined between the ends 26,27 of the pivot arm 25. Preferably, the pivot arm 25 is telescopically extendable along the length of the pivot arm 25 to permit adjustable extension and retraction of the length of the pivot arm 25.

Also preferably provided is a second input device 28 electrically connected to the computer 15 for inputting data into the computer 15. The second input device 28 is provided on one of the key pads 18. Examples of preferred the second input device 28 include a mouse, a track ball, a touch pad, and a joystick.

Figure 6:
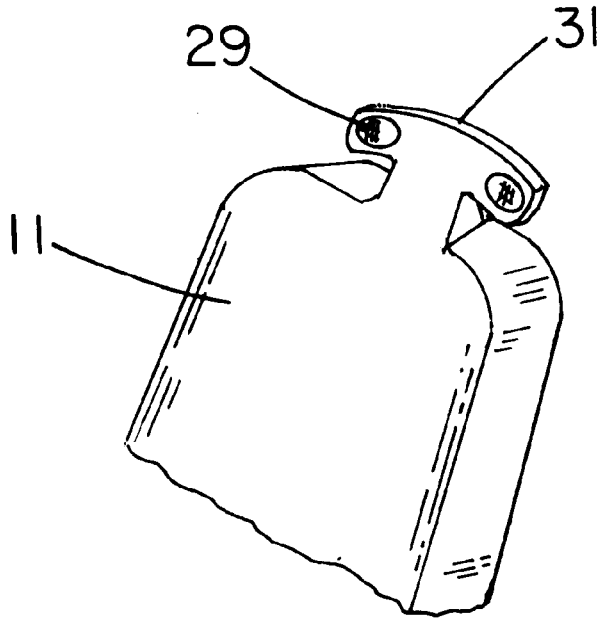
FIG. 6 is a schematic partial perspective view of a preferred embodiment of the present invention having speakers provided in a head rest mounted to the back rest.

Preferably, a pair of speakers 29,28 are electrically connected to the computer 15 for generating audible sounds from the computer 15. The speakers 29,28 is mounted to the back rest 11 adjacent the head of the user. In the preferred embodiment, the back rest 11 has a head rest 31 mounted thereto, on which the speakers 29,28 are provided as illustrated in FIG. 6. Optionally, the speakers 29,28 may be mounted to the monitor 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A computer workstation, comprising:

a reclining chair having a back rest, a seat, a leg rest, and a pair of arm rests;

said reclining chair having a support base for supporting said reclining chair above a surface;

a computer being mounted to said reclining chair;

a pair of key pads electrically connected to said computer for inputting data into said computer, each of said arm rests having a key pad swivelably attached thereto; and a monitor being electrically connected to said computer for displaying visual images from said computer, said monitor being pivotally connected to said back rest.

2. The computer workstation of claim 1, wherein said back rest is pivotable with respect to said seat, wherein said leg rest is pivotable with respect to said seat, wherein said support base is adjustably raisable to permit selective raising and lowering of said reclining chair, and wherein said seat is pivotable with respect support base.

3. The computer workstation of claim 2, wherein said reclining chair has a motorized device for pivoting said back rest, said seat, said leg rest, and raising and lowering said support base.

4. The computer workstation of claim 2, further comprising a controller for remotely controlling the pivoting of said back rest, said seat, and said leg rest and the raising and lowering of said support base.

5. The computer workstation of claim 4, wherein said controller is provided on one of said key pads.

6. The computer workstation of claim 1, wherein said computer is provided in a housing mounted beneath said seat.

7. The computer workstation of claim 1, wherein each arm rest has a swivel arm swivelable attaching the associated key pad to the respective arm rest, each swivel arm having a pair of ends, one of said ends of each swivel arm being pivotally attached to the associated arm rest, another of said ends of each swivel arm being pivotally attached to the associated key pad.

8. The computer workstation of claim 1, wherein each of said key pads is swivelable in a first position over said seat and a second position extending away from said seat, said first and second positions lying in a generally common plane.

9. The computer workstation of claim 1, wherein a pivot arm pivotally connects said monitor to said back rest, said pivot arm having a pair of opposite ends, a first of said ends of said pivot arms being pivotally coupled to said monitor, a second of said ends of said pivot arm being pivotally coupled to said back rest.

10. The computer workstation of claim 9, wherein said second end of said pivot arm is pivotally coupled to a side of said back rest.

11. The computer workstation of claim 9, wherein said second end of said pivot arm is pivotally coupled to a top end of said back rest.

12. The computer workstation of claim 9, wherein said pivot arm has a length defined between said ends of said pivot arm, said pivot arm being telescopically extendable along said length of said pivot arm.

13. The computer workstation of claim 1, further comprising a second input device for inputting data into said computer.

14. The computer workstation of claim 1, further comprising a pair of speakers being electrically connected to said computer for generating audible sounds from said computer, said speakers being mounted to said back rest.

15. The computer workstation of claim 14, wherein said back rest has a head rest mounted thereto, said speakers being provided on said head rest.

16. A computer workstation, comprising:

a reclining chair having a back rest, a seat, a leg rest, and a pair of arm rests;

said back rest being pivotable with respect to said seat, said leg rest being pivotable with respect to said seat;

said reclining chair having a support base for supporting said reclining chair above a surface, wherein said support base is adjustably raisable to permit selective raising and lowering of said reclining chair, wherein said seat is pivotable with respect support base;

said reclining chair having a motorized device for pivoting said back rest, said seat, said leg rest, and raising and lowering said support base;

a computer being mounted to said reclining chair, said computer being provided in a housing mounted beneath said seat;

a pair of key pads electrically connected to said computer for inputting data into said computer, each of said arm rests having a key pad swivelably attached thereto;

wherein each arm rest has a swivel arm swivelable attaching the associated key pad to the respective arm rest, each swivel arm having a pair of ends, one of said ends of each swivel arm being pivotally attached to the associated arm rest, another of said ends of each swivel arm being pivotally attached to the associated key pad;

each of said key pads being swivelable in a first position over said seat and a second position extending away from said seat, said first and second positions lying in a generally common plane;

a controller for remotely controlling the pivoting of said back rest, said seat, and said leg rest and the raising and lowering of said support base, said controller being electrically connected to said motorized device, said controller being provided on one of said key pads;

a monitor being electrically connected to said computer for displaying visual images from said computer, said monitor being pivotally connected to said back rest;

wherein a pivot arm pivotally connects said monitor to said back rest, said pivot arm having a pair of opposite ends, a first of said ends of said pivot arms being pivotally coupled to said monitor, a second of said ends of said pivot arm being pivotally coupled to said back rest;

wherein said second end of said pivot arm is pivotally coupled to a side of said back rest;

said pivot arm having a length defined between said ends of said pivot arm, said pivot arm being telescopically extendable along said length of said pivot arm;

a second input device for inputting data into said computer, said second input device being provided on another of said key pads, wherein said second input device is selected from the group comprising a mouse, a track ball, a touch pad, and a joystick;

a pair of speakers being electrically connected to said computer for generating audible sounds from said computer; and said back rest has a head rest mounted thereto, said speakers being provided on said head rest.

* * * * *